US005735559A

United States Patent [19]

Frolov

[11] Patent Number: 5,735,559

[45] Date of Patent: Apr. 7, 1998

[54] ELECTRIC STRIKE

[75] Inventor: George Frolov, Farmington, Conn.

[73] Assignee: Harrow Products, Inc., Grand Rapids, Mich.

[21] Appl. No.: 695,271

[22] Filed: Aug. 9, 1996

[51] Int. Cl.[6] ..... E05B 15/02

[52] U.S. Cl. ..... 292/341.16; 292/210; 292/337

[58] Field of Search ..... 292/341.17, 341.16, 292/210, 201, 229, 337

[56] References Cited

U.S. PATENT DOCUMENTS

| | | | |
|---|---|---|---|
| 2,128,014 | 8/1938 | Platin | 292/341.17 X |
| 4,302,039 | 11/1981 | Dukel et al. | 292/341.16 |
| 4,595,220 | 6/1986 | Hanchett, Jr. et al. | 292/341.16 X |
| 4,756,566 | 7/1988 | Logas | 292/341.16 |
| 4,867,496 | 9/1989 | Thomas | 292/341.16 |
| 4,986,584 | 1/1991 | Logas | 292/201 X |
| 5,042,857 | 8/1991 | Burrows et al. | 292/341.16 |
| 5,118,150 | 6/1992 | Jarrett | 292/341.16 |
| 5,195,792 | 3/1993 | Stendal | 292/341.16 |
| 5,219,196 | 6/1993 | Luker | 292/341.16 |

*Primary Examiner*—Rodney M. Lindsey
*Attorney, Agent, or Firm*—Alix, Yale & Ristas, LLP

[57] ABSTRACT

An electric strike has a strike frame defining a jamb face opening and a frame face opening generally orthogonal to and continuous with the jamb face opening. A keeper is pivotally mounted to the frame to close the frame face opening and is movable to an open position to open the frame face opening. A locking assembly locks the keeper in the closed position. The keeper and strike frame define a bolt receiving cavity. A modular monitoring assembly extends into the bolt receiving cavity and generates an output signal indicative of the presence of a bolt in the bolt receiving cavity.

24 Claims, 14 Drawing Sheets

ELECTRIC STRIKE

BACKGROUND OF THE INVENTION

This invention relates to the field of door security systems. More specifically, this invention relates to an electric strike for securing a door.

Electric strikes for securing hinged or swinging doors having projectable dead bolts or latch bolts are well known in the field of door security systems. Electric strikes are employed alone or in combination with other conventional security systems.

Electric strikes are typically mounted to the door frame and define an opening in the door jamb face for reception of a dead bolt and/or a latch bolt. The electric strike is further operable to define a opening in the frame face contiguous with the opening in the door jamb face. A lockable keeper selectively closes the opening in the frame face. A dead bolt or latch bolt projectable from the edge of the door engages the electric strike through the opening in the jamb face. Actuation of the electric door strike unlocks the keeper which then uncovers or opens the frame face opening allowing the bolts to swing therethrough. The door user can then pass through the open door. Electric strikes can be used in combination with retractable latch bolts and dead bolts to construct a wide variety of enhanced door security combinations.

While conventional electric strikes do provide an additional layer of management and control, typical electric door strikes can display several deficiencies. Typical electric strikes do not incorporate features to fully exploit the potential safety and security possibilities of the strike. Furthermore, conventional electric strikes are positioned in cavities in the door frame. The cavity space is typically very limited, allowing little additional space for the electric strike components. As a result, some electric strikes have positioned the solenoid driven lock mechanism into the moving keeper. Therefore the solenoid is moved with the keeper every time the keeper opens and closes. The positioning of the solenoid on the keeper places additional mechanical wear on the solenoid and wiring leading to the solenoid. The electrical wiring connecting the moving solenoid to the stationary door frame can thus wear and lead to loss of power to the solenoid.

SUMMARY OF THE INVENTION

Briefly stated, the electric strike in a preferred form has a strike frame defining a jamb face opening and a frame face opening contiguous with the jamb face opening. A keeper pivotally mounted to the strike frame opens and closes the frame face opening to allow dead bolts and latch bolts to swing through the frame face opening and therefore allow access through a doorway. The strike frame and keeper define a multi-sectional bolt receiving cavity for receiving dead bolts and latch bolts of mortise-type, cylinder and other locks mounted to the door. A monitoring assembly having modular monitoring capability monitors the presence of the dead bolt and/or latch bolt in the multi-sectional bolt receiving cavity. The monitoring assembly further monitors the open and closed positions of the keeper.

A lock assembly selectively locks the keeper in the closed position. A stationary mounted solenoid drives the lock assembly of the electric strike. Alternately, the lock assembly can be driven by a motor. A lock monitoring system further monitors the locked and unlocked states of the keeper and therefore the locked and unlocked states of the electric strike.

The electric strike of the invention preferably employs a lock assembly having a stationary solenoid or motor for locking the keeper in the closed position. The strike frame defines a bevel which facilitates the installation of the electric strike of the invention in the confined cavity of a typical door frame.

The monitoring assembly and lock monitoring assemblies preferably have modular monitoring capabilities and employ the same microswitches for reduced component cost and ease of customization of the electric strike to a particular door lock or security arrangement.

The bolt receiving cavity of the electric strike of the invention is generally elongated and oriented along the longitudinal axis of the door frame. A variety of face plates can be mounted over the bolt receiving cavity to accommodate different sizes, shapes, combinations and positions of dead bolts and latch bolts. Therefore, the electric strike of the invention requires only a single mounting procedure for different latches and bolts and thereby reduces installation time in a variety of operational environments. Furthermore, the monitoring assembly can be configured to monitor the dead bolts and/or latch bolts of different locks. The monitoring assembly can also be further configured to allow the electric strike to be universally mounted on either the left or right side of the door frame.

For example, cylinder door locks and mortise-type door locks typically have different spacing between the dead bolt and the latch bolt. The elongated longitudinally oriented bolt receiving cavity of the electric strike allows rapid and simplified placement of face plates on the electric strike to accommodate the large variety of different cylindrical and mortise locks without requiring the strike to be relocated.

An object of the invention is to provide an electric strike capable of being mounted in a single position and receiving different sizes, shapes, combinations and positions of dead bolts and latch bolts.

Another object of the invention is to provide an electric strike for monitoring the position of dead bolts and latch bolts in the bolt receiving cavity.

A further object of the invention is to provide an electric strike having a monitoring assembly for monitoring one or multiple lock latch statuses.

A still further object of the invention is to provide an electric door strike having modular switches.

A still further object of the invention is to provide an electric strike having a simplified installation procedure for mounting the electric strike in the cavity of a door frame.

A yet further object of the invention is to provide an electric door strike that can be readily configured or reconfigured for different door locks.

These and other objects and features of the invention will become apparent from the specification and the drawings.

DETAILED DESCRIPTION OF THE PREFERRED EMBODIMENT

Figure 1:
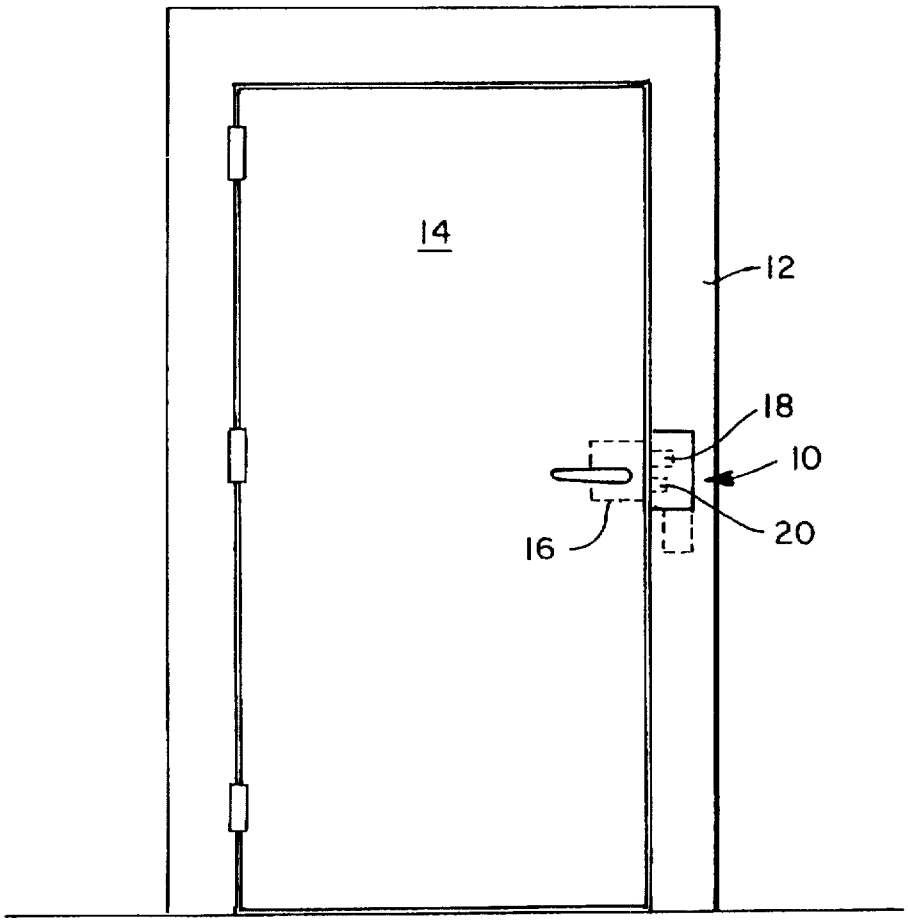
FIG. 1 is a front view, partially in phantom, of a door strike of the invention mounted to a door frame in combination with a door and a door mounted lock.

With reference to the drawings, wherein like numerals represent like components throughout the figures, an electric door strike in accordance with the invention is generally designated by the numeral 10. The electric strike 10 is mounted to a door frame 12 supporting a door 14 hinged thereto. The door 14 mounts a door lock 16 having a dead bolt 18 and a latch bolt 20 projectable from the door lock 16 at the door edge for selectively locking engagement with the electric strike 10. The electric strike 10 can have application with various latch bolts, dead bolts and multiple latch bolt/dead bolt combinations and configurations.

Figure 9:
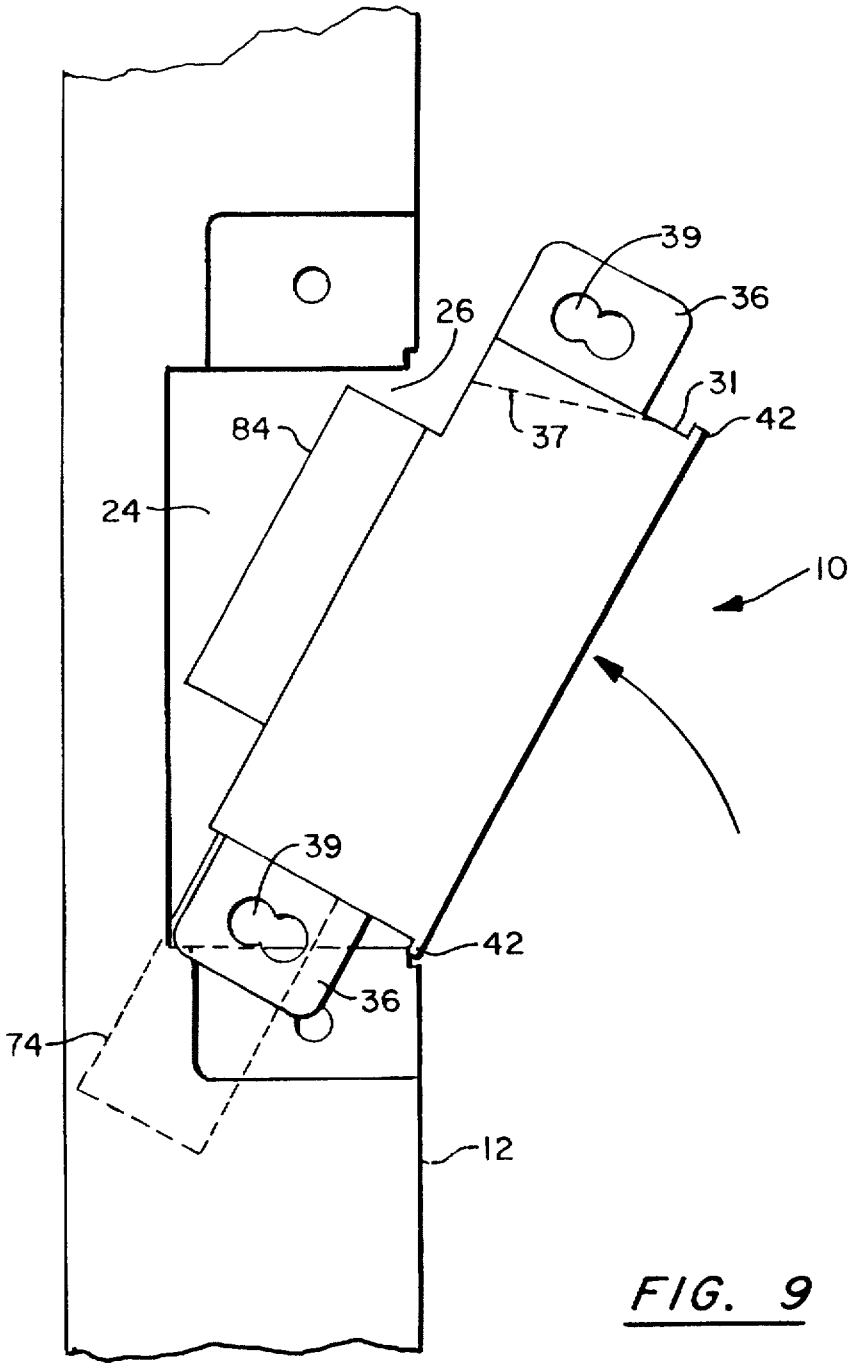
FIG. 9 is a side installation view, partially in phantom, of the electric door strike and door frame of FIG. 2 illustrating an installation step for the electric strike.

The door frame 12 is preferably formed of a hollow metal extrusion defining a door cavity 22. (See FIG. 9) The door frame 12 can also be constructed of wood or other materials and mortised to define the door cavity 22. The electric strike 10 installs through a frame opening 24 formed by removal of a corner section of the door frame 12. The door frame opening 24 therefore may be conceptualized as having a door frame-jamb face opening 26 oriented toward the door 14. The frame opening further has a door frame-frame face opening 28 oriented generally parallel to the door 14 and generally perpendicular to and contiguous with the door frame-jamb face opening 26. The frame opening 24 is positioned to be generally opposite the door lock 16 for extension of the dead bolt 18 and latch bolt 20 into the door frame opening 24. The electric strike 10 is positioned and installed within the door frame opening 24, preferably with a procedure to be described below.

Figure 5:
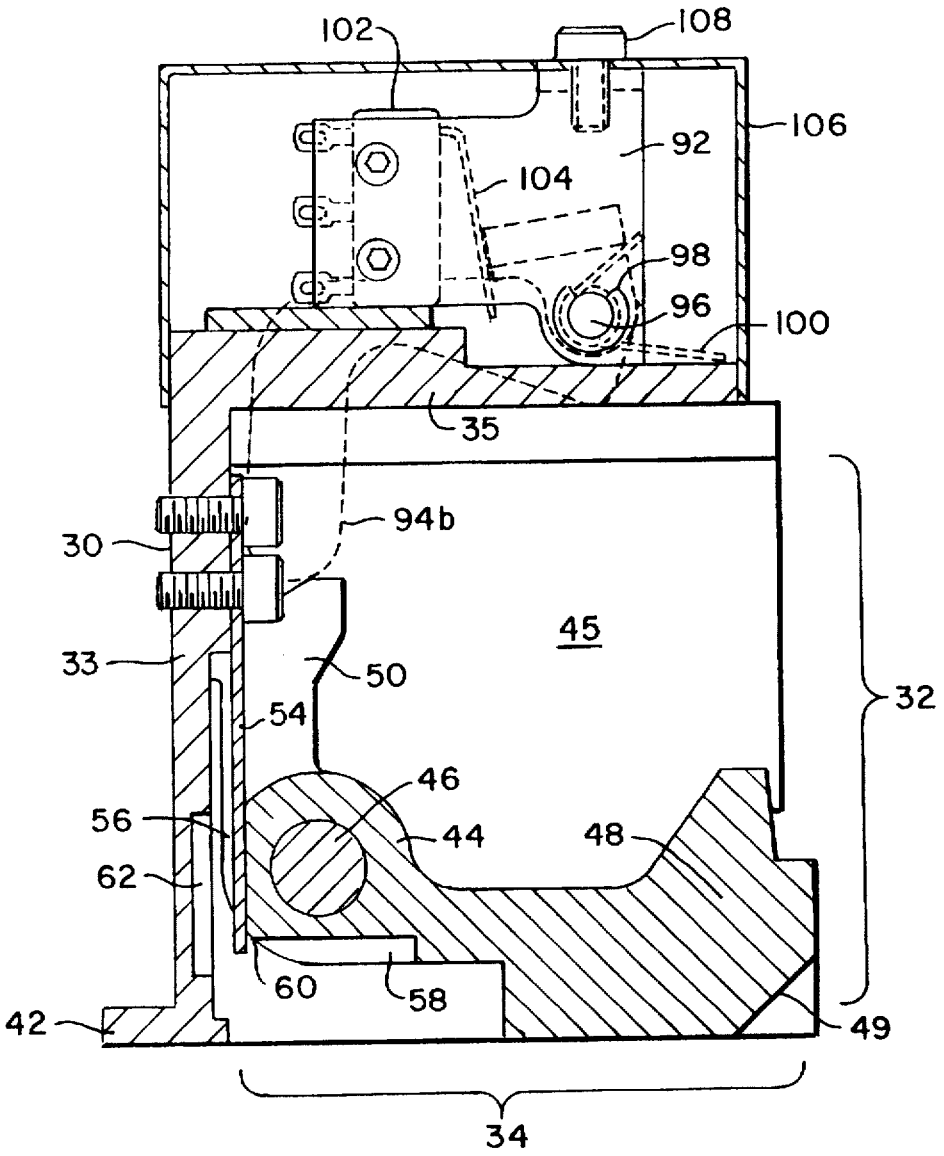
FIG. 5 is a cross-sectional view, partially in phantom, of the electric door strike of FIG. 3, taken along the line 5—5.

The electric strike 10 has a strike frame 30. The strike frame 30 is preferably a generally rectangular box having a rectangular notch. The strike frame 30 therefore defines a jamb face opening 32 oriented toward the edge of the door 14, and a frame face opening 34 contiguous with and generally perpendicular to the jamb face opening. (See FIG. 5) The jamb face opening 32 of the electric strike 10 is generally in the same plane as the door frame-jamb face opening 26, and the frame face opening 34 of the electric strike 10 is generally in the same plane as the door frame-frame face opening 28. The strike frame 30 has a jamb face wall 33 generally oppositely positioned from the jam face opening 32, a frame face wall 35 generally oppositely positioned from the frame face opening 34, and oppositely positioned end walls 29, 31.

Figure 3:
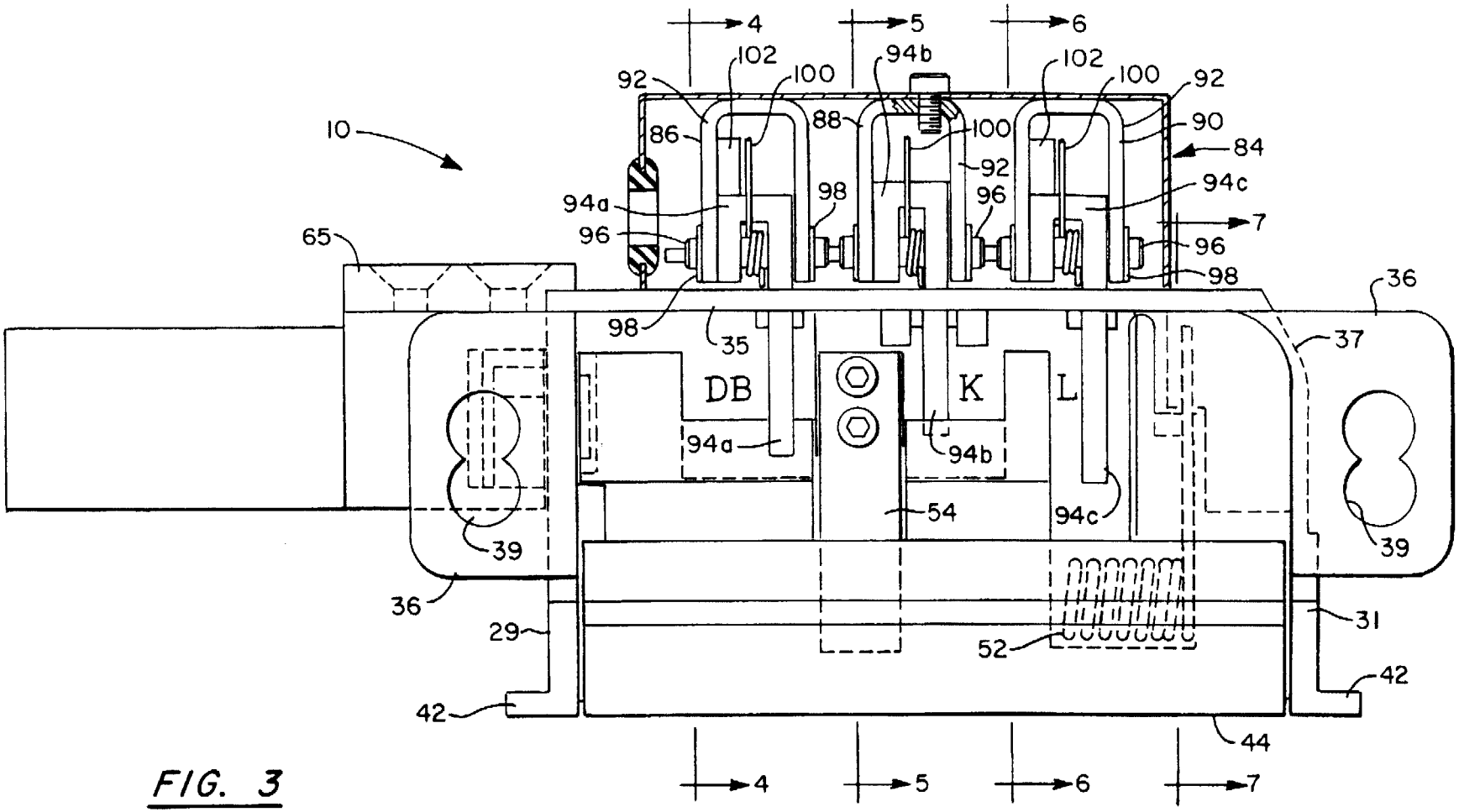
FIG. 3 is a side view, partially in phantom and partially in section, of the electric door strike of FIG. 2.

Mounting flanges 36 extend longitudinally from the strike frame 30 for mounting the door strike 10 to the jamb face side of the door frame 12. The mounting flanges 36 are preferably planar with the jamb face opening 32. Each mounting flange 36 defines a mounting opening 37 for the extension of fasteners 40 therethrough. (See FIGS. 3 and 9) The mounting openings 37 are preferably overlapped circular openings having centers of curvatures spaced apart approximately 3/16 of an inch. Therefore the strike frame can be horizontally positioned to project outward from the door frame 12 to compensate for weatherstripping, silencers, or other materials disposed between the door 14 and the door frame 12.

A face plate 38, defining U-shaped bolt passages 39 for the passage of the bolts 18, 20, is positioned over the mounting flanges 36 and across the jamb face opening 32. The face plate 38 can be rapidly replaced to accommodate different sizes, shapes and locations of latch bolts 20 and dead bolts 18. The fasteners 40 extend through the face plate 38 and threadably engage the door frame 12 to support the mounting flanges 36 therebetween. The mounting flanges 36 and face plate 38 are preferably recessed into the door frame 12 for a smooth appearance. A mounting lip 42 extends from the strike frame 30 and is recessed into the door frame 12 to further support the strike frame 30 to the door frame 12.

A longitudinally oriented elongated keeper 44 pivotally mounts within the strike frame opening. The keeper 44 defines a generally L-shaped cross-section having a strike arm 48 and a return arm 50 generally perpendicular to the strike arm 48. A longitudinally oriented pivot rod 46 extends through generally the vertex of the strike arm 48 and return arm 50. The pivot rod 46 mounts to the strike frame 30 to provide for pivoting motion of the keeper 44 in the strike frame 30. The keeper 44 has a closed position, wherein the strike arm 48 extends across the frame face opening 34 and the return arm 50 is generally parallel to the jamb face wall 33 of the strike frame 30. The strike arm 48 in the closed position further extends across the open side of the U-shaped bolt passages 39 of the face plate 38. The keeper 44 is pivotable on the pivot rod 46 from the closed position through generally a 90° arc to an open position. In the open position of the keeper 44, the strike arm 48 extends outward through the frame face opening 34 and the return arm 50 extends across the bolt receiving cavity 45. The jamb face wall 33, frame face wall 35 and keeper 44 in the closed position define a multi-sectional bolt receiving cavity 45 for introduction of the bolts 18, 20 into the electric strike 10. The keeper 44 is pivotable to the open position to expose the open side of the bolt passages 39 and the bolt receiving cavity 45. The bolts 18, 20 can then be swung through the frame face opening 34.

Figure 4:
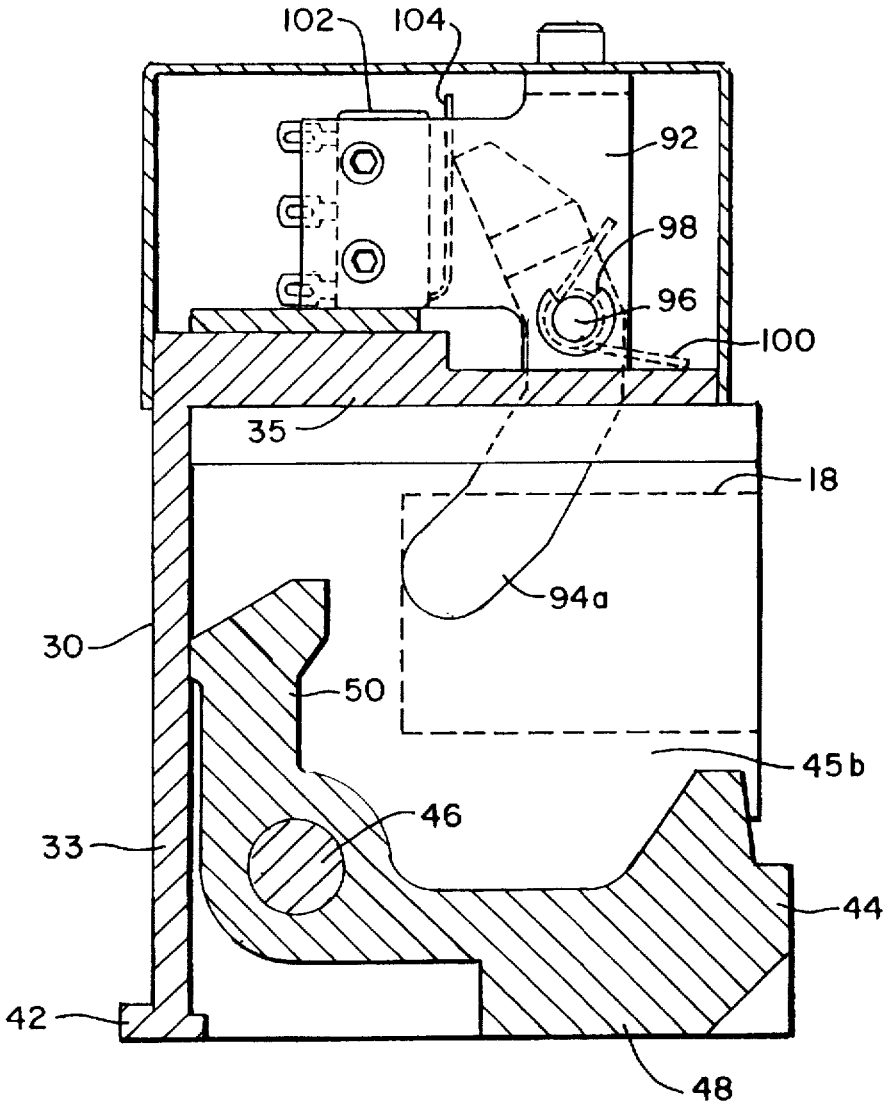
FIG. 4 is a cross-sectional view, partially in phantom, of the electric door strike of FIG. 3, taken along the line 4—4 as shown in combination with a dead bolt.
Figure 6:
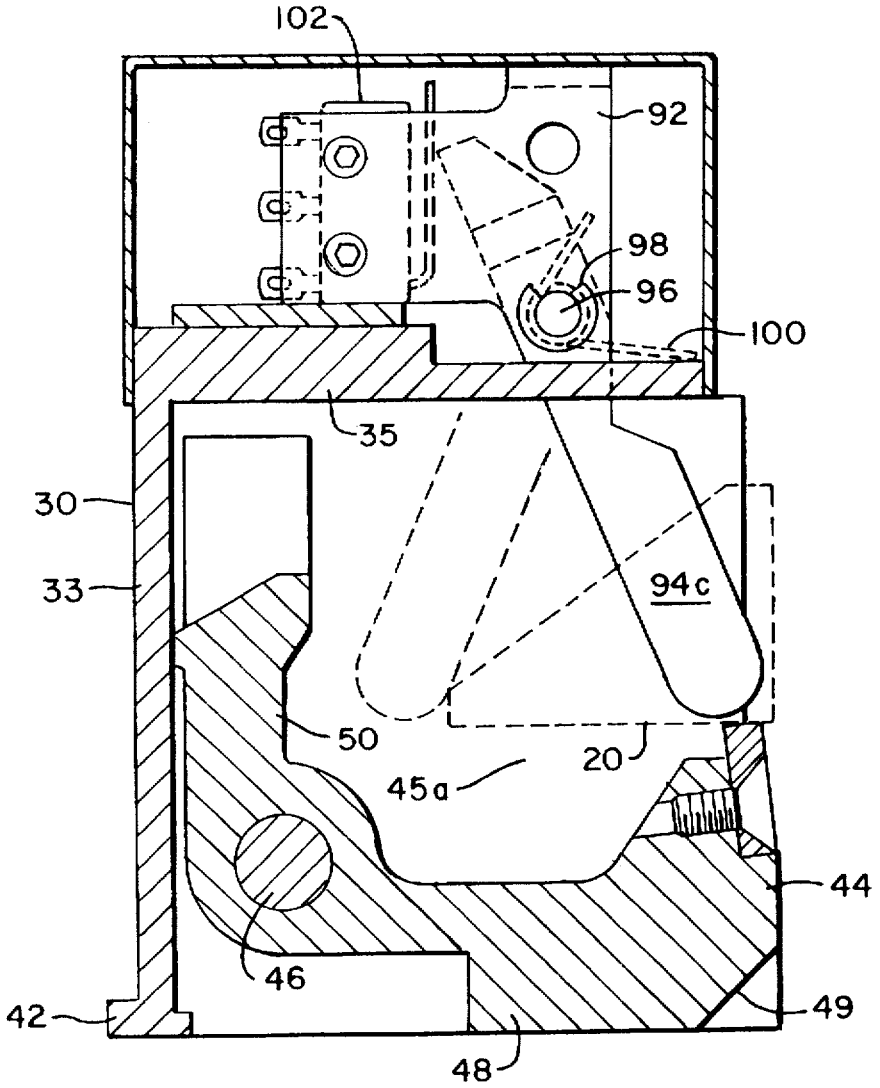
FIG. 6 is a cross-sectional view, partially in phantom, of the electric door strike of FIG. 3, taken along the line 6—6 and shown in combination with a latch bolt.

The face plate 38 in combination with the keeper 44 and strike frame 30 defines a latch bolt cavity section **45*a* and a dead bolt cavity section 45*b* within the multi-sectional bolt receiving cavity 45. (See FIGS. 2, 4 and 6) The latch bolt cavity section 45*a* and dead bolt cavity section 45*b* correspond with the bolt openings 39 in the face plate 38. Therefore, alternate face plates 39 can be readily installed to reposition cavity sections 45*a*, 45*b*** for various latch bolts, dead bolts and combinations thereof.

Figure 7:
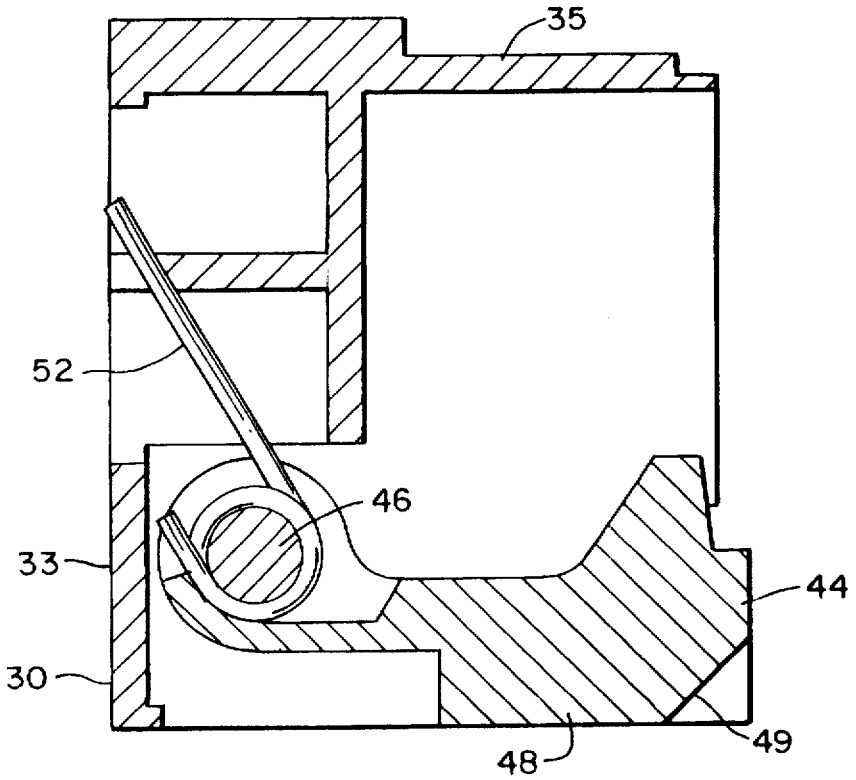
FIG. 7 is a cross-sectional view of the electric door strike of FIG. 3, taken along the line 7—7.

A coiled keeper spring 52 generally biases the keeper 44 to the closed position. (See FIG. 7) The keeper spring 52 encircles the pivot rod 46 and engages at one end the strike frame 30, and at the other end the keeper 44.

A flat spring 54, having one end mounted to the jamb face wall 33 of the strike frame 30, slidingly engages the keeper 44. (See FIG. 5) The return arm 50 defines a closed position recess 56 generally parallel to the return arm 50. The strike arm 48 defines an open position recess 58 generally parallel to the strike arm 48. The closed position recess 56 and open position recess 58 are preferably orthogonally positioned and define a corner 60. The flat spring 54 engages the closed and open position recesses 56, 58 to maintain the keeper 44 in either the open or closed positions, as will be further described below.

Initially in the closed position of the keeper 44, the flat spring 54 engages the closed position recess 56. To pivot the keeper to the open position, sufficient force must be applied to the keeper 44 to overcome both the keeper spring 52 and flat spring 54 engaging the closed position recess 56. In use, when the keeper 44 is in an intermediate position between the open and closed positions, the flat spring 54 engages the corner 60 of the keeper 44 to drive the keeper 44 to one of the opened or closed positions. Therefore, the flat spring 54 acts on the keeper 44 to generally maintain the keeper 44 in either the fully opened or fully closed positions. When the keeper 44 pivots over generally half the arc to the open position, the force of the flat spring 56 engaging the corner 60 is sufficient to complete the pivoting of the keeper 44 to the fully open position. The flat spring 54 engaging the corner 60 overcomes the biasing force of the keeper spring 52 and pivots the keeper 44 until the flat spring 54 is fully engaged in the open position recess 58.

The strike frame 30 defines a spring recess 62 in the jamb face wall 33 opposite the end of the flat spring 54. The spring recess 62 provides clearance for the flat spring 54 to flex and therefore prevents interference between the frame 30 and the flat spring 54 as the keeper 44 rotates.

Figure 2:
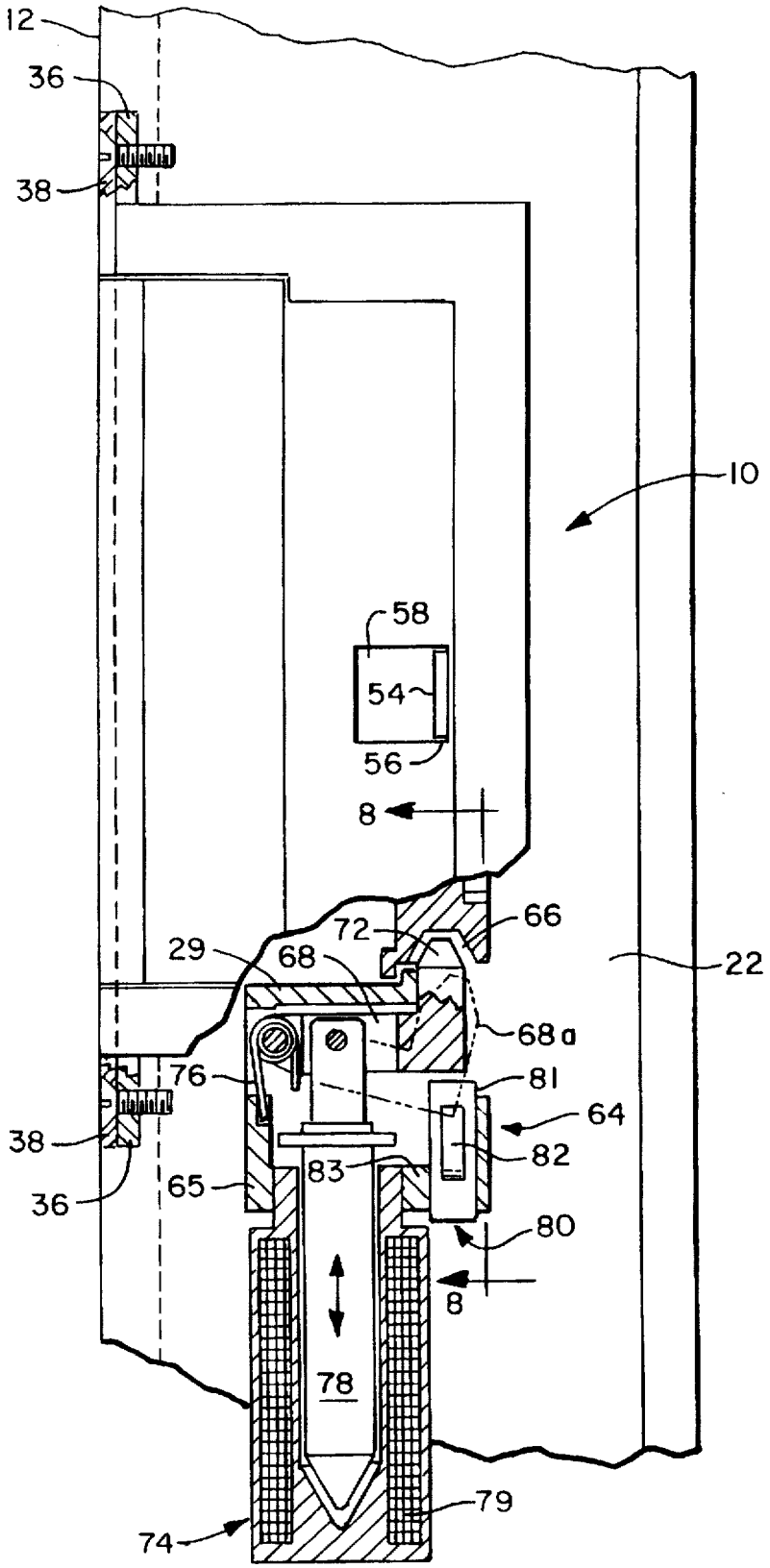
FIG. 2 is a frontal view, partially broken away, partially in phantom and partially in section, of the electric door strike of FIG. 1 illustrated in conjunction with a portion of a door frame.
Figure 8:
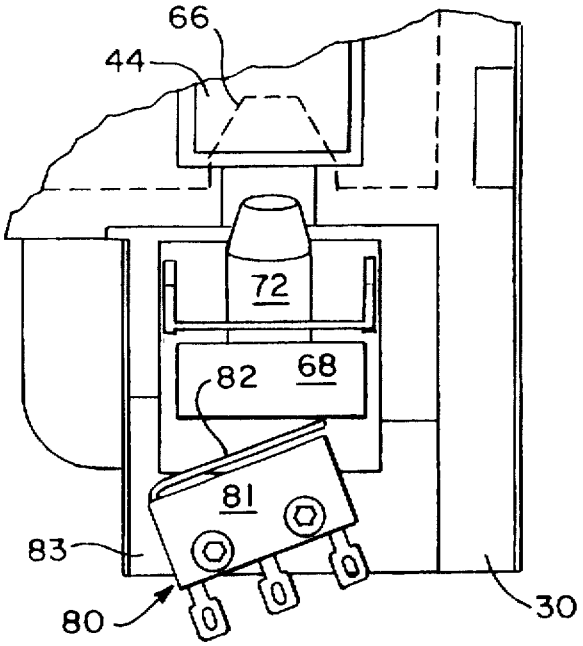
FIG. 8 is an enlarged broken away view of the electric door strike of FIG. 2, taken along the line 8—8.

With reference to FIGS. 2 and 8, a lock assembly 64 extends generally longitudinally from the end wall 29 of the strike frame 30. The lock assembly 64 has a lock assembly frame 65 mounted to the strike frame 30. The lock assembly 64 selectively locks the keeper 44 in the closed position. The keeper 44 defines a conical lock recess 66 adjacent the end wall 29 of the strike frame 30. A lock swing arm 68 pivotally mounts to the lock assembly frame 65 at a first end, and supports a lock pin 72 at the second end. (See FIG. 8) The lock pin 72 is positionable in the lock recess 66 by the swing arm 68 to lock the keeper 44 in the closed position and prevent rotation of the keeper 44 to the open position. The lock pin 72 is preferably conically shaped to allow locking of the keeper 44 even when slight misalignment occurs between the conical lock pin 72 and conical lock recess 66. The conical surfaces of the lock recess 68 and the lock pin 72 can therefore slidably engage even if there is a misalignment of the lock pin 72 and the keeper 44. The lock swing arm 68 is pivotable to a unlocked position **68*a* wherein the lock pin 72 is removed from the lock recess 66. The keeper 44** can then be rotated to the open position by application of an appropriate force.

With reference to FIG. 2, a solenoid 74, having an armature 78 and a coil 79, engages to the lock swing arm 68 to drive the lock swing arm 68. The solenoid 74 electromagnetically moves the armature 78 longitudinally to pivot the lock swing arm 68 between the locked or unlocked positions. A lock spring 76 biases the lock swing arm 72 to either the locked or unlocked positions.

In a fail-secure arrangement, the lock spring 76 biases the swing arm 68 to the locked position. Energizing of the solenoid 74 electromagnetically retracts the armature 78 longitudinally into the coil 79. The electromagnetic force of the solenoid 74 overcomes the spring force of the lock spring 76, therefore retracting the lock pin 72 from the lock recess 66. In the fail-secure arrangement, loss of power to the electric strike 10 maintains the keeper 44 in the locked state.

Alternately, in a fail-safe arrangement, the lock spring 76 biases the lock swing arm 68 to the unlocked position **68*a*. Continual energization of the solenoid 74 electromagnetically drives the armature 78 longitudinally out of the coil 79 to maintain the locking pin 72 in the lock recess 66. In the event of loss of power to the solenoid 74, the lock spring 76 biases the lock swing arm 68 to the unlocked position so the door 14** can be opened and allow ready emergency access through the doorway.

Figure 11:
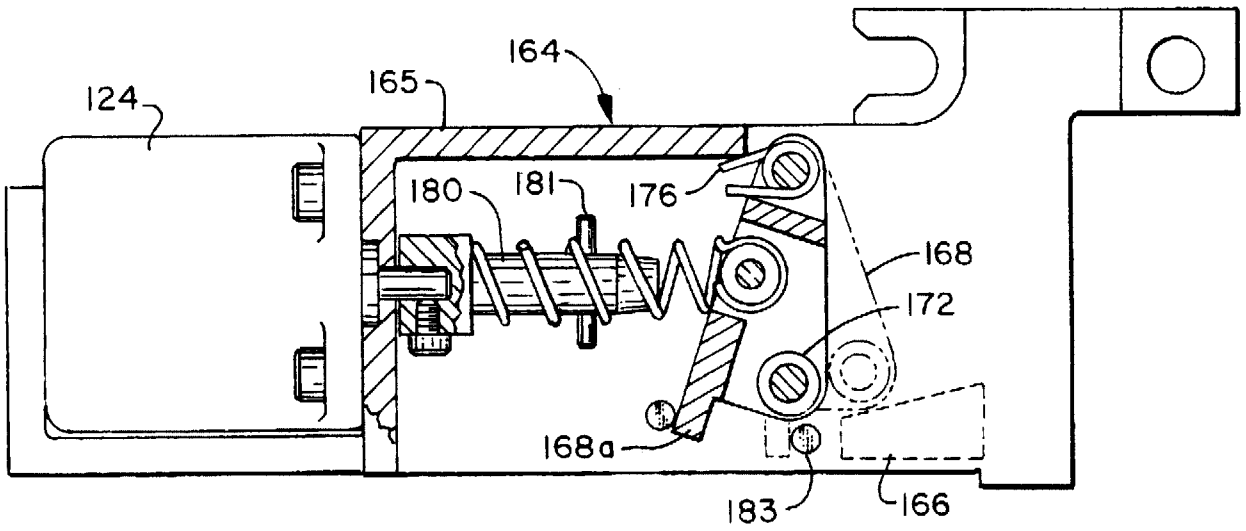
FIG. 11 is an enlarged fragmentary cross-sectional side view, partially broken away and partially in phantom, of an alternate embodiment of a lock assembly in accordance with the invention.
Figure 12:
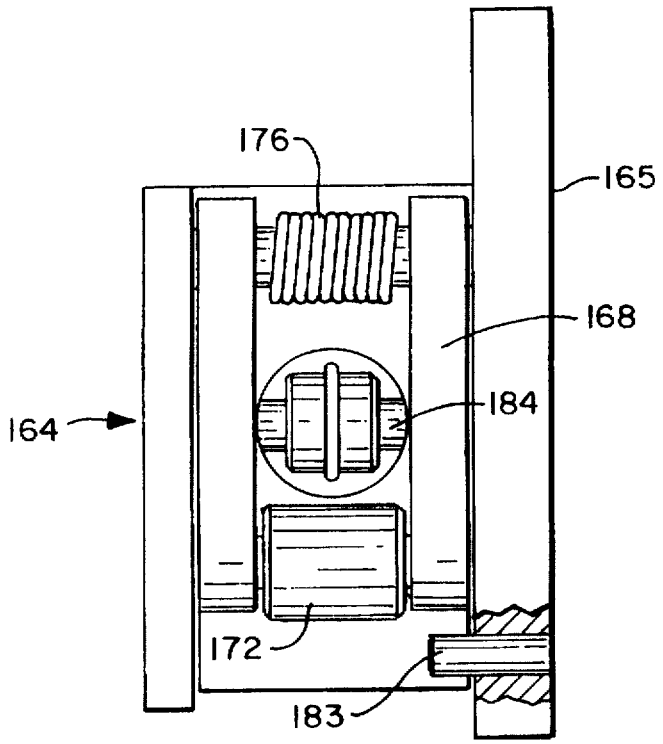
FIG. 12 is an end view of the lock assembly of FIG. 11.
Figure 13:
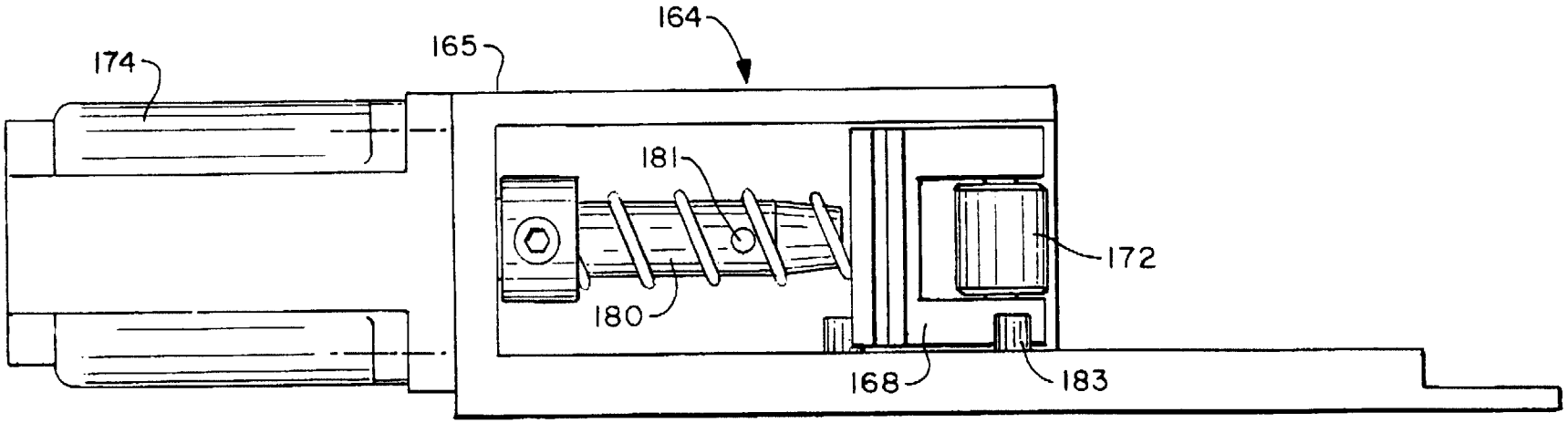
FIG. 13 is a bottom view of the lock assembly of FIG. 11.

In an alternate embodiment, a motor driven lock assembly 164 locks the keeper 44 in the closed position. (See FIGS. 11–13) The lock assembly 164 has a lock assembly frame 165 extending longitudinally from the strike frame 30. A lock swing arm 168 pivotally mounts to the lock assembly frame 165 at a first end, and supports a lock roller 172 at the second end. The keeper 44 defines a lock bevel 166 adjacent the end wall 29 of the strike frame 30. The lock roller 172 is rollingly engageable against the lock bevel 166 by the swing arm 168 to lock the keeper 44 in the closed position. The lock bevel 166 is angled to allow locking of the keeper 44 even when slight misalignment occurs between the lock roller 172 and lock bevel 166. The lock roller 172 and lock bevel 166 can therefore rollingly engage even if there is misalignment of the lock roller 172 and the keeper 44. The lock swing arm 168 is further pivotable to an unlocked position **168*a* wherein the lock roller 172 is disengaged from the lock bevel 166. A lock spring 176 biases the lock swing arm 168 to the locked position against a position pin 183**.

A motor 174 is coupled to the swing arm 168 to drive the swing arm 168 between the locked and unlocked positions. The motor rotates a motor post 180 having a transverse drive pin 181. A coil spring 182 has one end surrounding the motor post 180 and the opposite end hooked around a lock arm pin 184 on the lock arm 168. Each end of the drive pin 181 extends between the coils of the spring 182. Rotation of the drive pin 181 by the motor 174 threadably engages the drive pin 181 against the coil faces of the spring 182, thereby tensioning the spring 182 sufficiently to overcome the biasing force of the lock arm spring 176 and disengage the lock roller 172 from the keeper 44. The lock arm 168 pivots until engaged against a position pin 184. The stretching of the spring 182 allows the motor 174 to consistently over-rotate without damaging the lock assembly 164, while forcing the lock arm 168 to the desired locked or unlocked positions.

Figure 14:
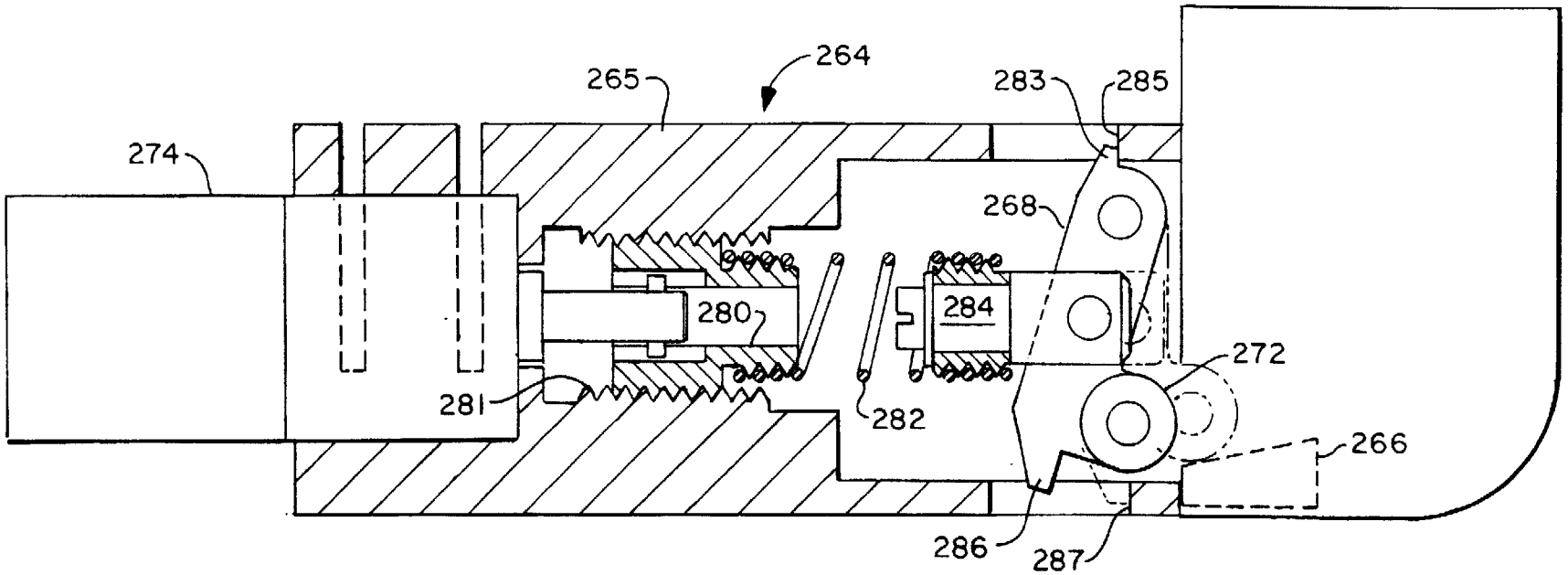
FIG. 14 is an enlarged fragmentary cross-sectional side view, partially broken away and partially in phantom, of another alternate embodiment of the lock assembly in accordance with the invention.

With reference to FIG. 14, in another embodiment of a motor driven locking assembly 264, a lock swing arm 268 pivotally mounts at one end to a locking assembly frame 265, and rotatably supports a lock roller 272 at the second end. The lock roller 272 engages a lock bevel 266 on the keeper 44 as described above. A motor 274 rotates a threaded drive post 280 to drive the lock swing arm 268 between the locked and unlocked positions. The drive post 280 threadably engages a threaded bore 281 defined by the locking assembly frame 265. Rotation of the drive post 280 by the motor 274 axially drives the drive post 280 along the bore 281. A threaded pin 284 is pivotably fixed to the mid portion of the lock swing arm 268. A coil spring 282 couples the drive post 280 and the pin 284. The coil spring 282 is fixed by threaded engagement at one end to the drive post 280, and also fixed by threaded engagement at the opposite end to the threaded pin 284. The axial motion of the drive post 280 in the bore 281 expands or contracts the coil spring 282. The post 280 is rotated in one direction to expand the spring 282 and pivot the lock swing arm 268 to the unlocked position. The lock swing arm 268 defines a position arm 283 that engages an unlocked position stop 285 when the spring 282 is sufficiently contracted. Rotation of the post 280 in the opposite direction compresses the spring 282 thereby pivoting the lock swing arm 268 to the locked position wherein a position arm 286 defined by the lock swing arm 268 engages a locked position stop 287. The expansion and compression of the spring 282 accommodates any jamming condition and allows deliberate over-rotation of the motor in either direction and does not require that the motor shaft be indexed in order to assure full seating of the lock swing arm 268 in the locked and unlocked positions against the locked and unlocked position stops 285, 287, respectively.

A lock position switch assembly 80 (See FIGS. 2 and 8) contacts the lock swing arm 68 and generates an output signal indicative of the locked and unlocked positions of the swing arm 68. The lock position switch assembly 80 has a position switch 81 and a switch mount 83 for mounting the position switch 81 to the lock assembly frame 65. The position switch 81 is preferably a micro switch having a switch arm 82 slidably engaging the rear portion of the lock swing arm 68.

A monitoring assembly 84 (See FIGS. 3 and 9) monitors the positions of the keeper 44, latch bolts 20 and dead bolts 18 extending into the bolt receiving cavity 45. The monitoring assembly 84 is preferably positioned on the frame face wall 35 of the strike frame 30 for compactness and efficient mounting of the door strike 10 to the door frame 12. The monitoring assembly 84 has a dead bolt position switch assembly 86, a keeper position switch assembly 88 and a latch bolt position switch assembly 90. Each position switch assembly 86, 88, 90 has an inverted U-shaped switch frame 92 mounted to the strike frame 30. A monitoring arm 94*a*, 94*b*, 94*c* rotatably mounts by use of a pivot pin 96 to one of the switch frames 92. Each pivot pin 96 is supported in a longitudinal position within the respective switch frame 92 by C-shaped retaining clips 98. The retaining clips 98 engage a groove on each end of each pivot pin 96. A biasing spring 100, positioned around each pivot pin 96, contacts one of the switch frames 92 to bias the respective monitoring arm 94*a*, 94*b*, 94*c* mounted thereto to a first position.

Engaging a first end of each monitoring arm 94*a*, 94*b*, 94*c* is a position switch 102. (See FIGS. 4, 5 and 6) Each position switch 102 is preferably a micro switch having a switch arm 104 slidably engaging the end of the respective monitoring arm 94*a*, 94*b*, 94*c*. It is preferable that all the position switches 102, including the position switch 81 of the lock position switch assembly 80, be identical for reduced cost, simplified maintenance, and modular replacement of switch components. The monitoring assembly 84 further has a switch housing 106 mounted over the switch assemblies 86, 88, 90 and fixed in place by a fastener 108 threadably engaging one of the switch frames 92. The switch housing 106 defines a wiring passage 110 having a grommet 112 to prevent wear to wiring (not shown) for the switches 102.

The angled monitor arm 94*a* of the dead bolt position switch assembly 86 extends through an opening in the strike frame 30 and into the dead bolt cavity section 45*b* of the bolt receiving cavity 45. (See FIG. 4) The dead bolt 18 slidingly engages the monitoring arm 94*a* when in the dead bolt cavity section 45*b*. The sliding engagement of the dead bolt 18 and the monitoring arm 94*a* rotates the monitoring arm 94*a* on the pivot pin 96 and actuates the position switch 102. Actuation of the position switch 102 generates an output signal indicative of the presence of the dead bolt 18 in the bolt receiving cavity 45.

Similarly, the straight monitoring arm 94*c* of the latch bolt position switch assembly 90 extends through an opening in the strike frame 30 and into the latch bolt cavity section 45*a* of the bolt receiving cavity 45. (See FIG. 6) The latch bolt 20 slidingly engages the monitoring arm 94*c* when the latch bolt 20 is in the latch bolt cavity section 45*a*. The sliding engagement of the latch bolt 20 and the monitoring arm 94*c* rotates the monitoring arm 94*c* on the pivot pin 96 and actuates the monitoring switch 102. Actuation of the switch 102 generates an output signal indicative of the presence of the latch bolt 20 in the bolt receiving cavity 45. The monitoring arms 94*a*, 94*c* of the bolt position switch assemblies 86, 90 can be readily alternately shaped to engage dead bolts and latch bolts of differing shapes, sizes and orientations.

The monitoring arm 94*b* of the keeper position switch assembly 88 extends through an opening in the strike frame 30 and slidingly engages the return arm 50 of the keeper 44. (See FIG. 5) Rotation of the keeper 44 to the open position rotates monitoring arm 94*b* on pivot pin 96, therefore actuating the position switch 102. Actuation of position switch 102 generates an output signal indicative of the keeper 44 being in the open position.

The bolt position switch assembly 86, keeper position switch assembly 88 and latch position switch assembly 90 are positionable at alternate locations on the jamb face wall 33 to extend into the bolt receiving cavity 45. For example, for door locks having latch bolts and dead bolts in different positions, the dead bolt position switch assembly 86 and latch bolt position switch assembly 90 can be moved longitudinally and alternated relative to each other to engage the differing positions of the dead bolts and/or latch bolts. Furthermore, the electric strike 10 is preferably universally positionable at either the left or right side of the door. Therefore the position switch assemblies 86, 88, 90 can be positioned to correspond the latch bolt and dead bolt positions of the left handed or right handed locks. Therefore the latch bolt position switch assembly 90 and dead bolt position switch assembly 86 can be repositioned to extend in the different latch bolt cavity sections 45*a* and dead bolt cavity sections 45*b* defined by the bolt openings 39 of different face plates 38.

Figure 10:
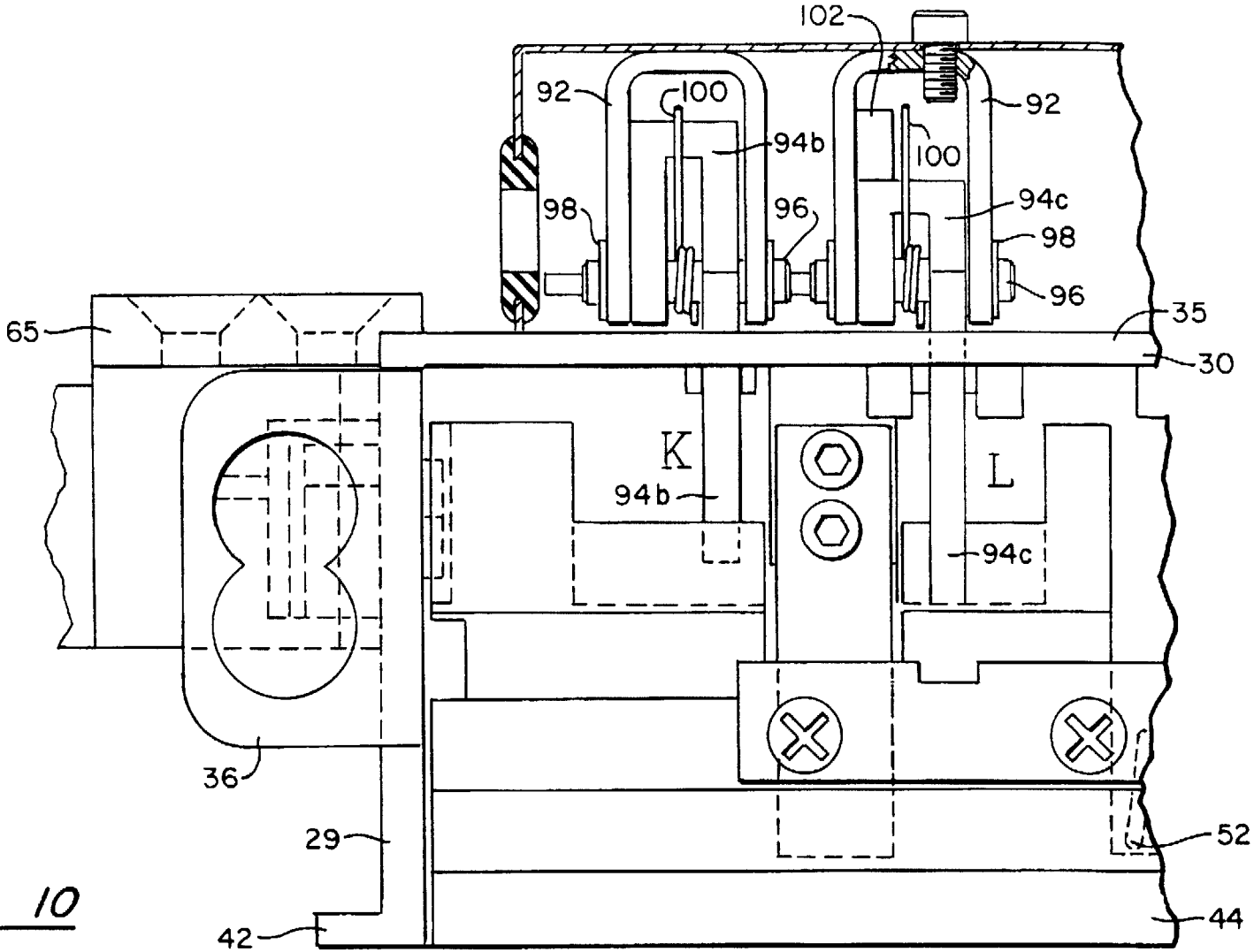
FIG. 10 is a fragmentary side view, partially in phantom and partially in section, of the electric door strike of FIG. 2 having an alternate monitoring assembly.

Similarly, the keeper position switch assembly 88 can be moved longitudinally relative to the bolt position switch assemblies 86, 90 to allow adequate room for repositioning the latch bolt and dead bolt position switch assemblies 86, 90. Furthermore, with regard to particular security situations and the level of monitoring required, only some of the position switch assemblies 80, 86, 88, 90 will be required to be mounted to a given electric strike 10. For example, for a door lock only having a single latch bolt 20, only the keeper position switch assembly 88 and latch bolt position switch 90 may be required to be mounted to the strike frame 30. (See FIG. 10) Therefore the monitoring assembly 84 can be modularly configured for a variety of door locks having latch bolts, dead bolts or combinations thereof, and modularly configured for mounting of the electric strike 10 to the left or right side of a door frame.

In use, the electric strike 10 configured for a door lock having a dead bolt 18 and a latch bolt 20 will typically normally maintain the keeper 44 in the closed position and locked by the lock assembly 64. The door 14 is closed and the dead bolt 18 and latch bolt 20 extend through the bolt passages 39 in the face plate 38 and into the bolt receiving cavity 45. In order to open the door, an electric strike control mechanism will actuate the solenoid to pivot the lock swing arm 68. Pivoting of the swing arm 68 removes the lock pin 72 from the lock recess 66. The lock position switch assembly 80 is actuated by the pivoting lock swing arm 68 and generates an output signal indicative of the unlocked state of the electric strike 10. The door user will then place pressure on the door to swing it outward, therefore forcing the dead bolt 18 and latch bolt 20 against the strike arm 48 of the keeper 44. The door user must exert a sufficient force to overcome both the biasing force of the keeper spring 52 and the retaining force of the flat spring 54.

The keeper 44 will then rotate on the pivot rod 46 through approximately 90° to release the dead bolt 18 and latch bolt 20 from the bolt receiving cavity 45 and allow the door 14 to swing open. If the keeper 44 has not attained the fully opened position, the flat spring 54 will continue to apply pressure against the corner 60 until the flat spring 54 fully seated in the open position recess 58.

With the door 14 swung open, and the keeper 44 in the open position, the dead bolt position switch assembly 86 generates an output signal indicative of the absence of the dead bolt 18 from the bolt receiving cavity 45. The keeper switch assembly 88 and the latch bolt position switch assembly 90 also generate output signals indicative of the keeper 44 in the open position and the latch bolt 20 being absent from the bolt receiving cavity 45 respectively.

When the door 14 swings back to a closed position, the extended dead bolt 18 engages the return arm 50 of the keeper 44, overcoming the retaining force of the flat spring 54 and rotating the keeper 44 back to the closed position. If the keeper 44 fails to attain the fully closed position, the flat spring 54 continues to apply pressure to the corner 60 until the flat spring 54 is fully seated in the closed position recess 56. The dead bolt position switch assembly 56 then generates an output signal indicative of the presence of the dead bolt 18 in the bolt receiving cavity 45. Furthermore, the keeper position switch assembly 88 indicates the closed position of the keeper 44, and the latch bolt position switch assembly 90 indicates the presence of the latch bolt 20 in the bolt receiving cavity 45.

The electric strike 10 configured for use with a door lock having only a latch bolt 20 will not generally employ a flat spring 54. The electric strike 10 will unlock in the same manner as described above. However, when the door user attempts to push open the door 14, only a force sufficient to overcome the biasing force of the keeper spring 52 will be required to open the door 14. The latch bolt 20 will contact the strike arm 48 of the keeper 44 to rotate the keeper 44 to the open position as the door 14 swings open. When the door 14 swings open sufficiently to disengage the latch bolt 20 from the strike arm 48, the biasing force of the keeper spring 52 returns the keeper 44 to the closed position. After the door user clears the doorway, the door swings closed. The beveled face of the latch bolt 20 then slidingly engages the beveled back portion 49 of the strike arm 48. (See FIG. 6) The latch bolt is therefore driven into the door lock allowing the door 14 to fully close. When the door 14 is fully closed, the biasing of the latch bolt 20 re-extends the latch bolt 20 into the bolt receiving cavity 45.

For particular forms of security systems, the latch bolt 20 and dead bolt 18 can be retracted into the door 14 and the door 14 opened without unlocking and opening the electric strike 10. For these particular security systems, the dead bolt position switch assembly 86 and the latch bolt position switch assembly 90 will indicate the absence of the dead bolt 18 and latch bolt 20 respectively from the bolt receiving cavity 45 even as the keeper 44 remains in the closed position.

The electric strike 10 of the invention is constructed for simplified installation into the door frame cavity 22. (See FIG. 9) In the preferred installation procedure, the longitudinally extending solenoid 74 is first inserted through the door frame-frame face opening 28, and into the door frame cavity 22. The solenoid will extend downward into the door frame cavity 22 or upward into the door frame cavity 22 depending on whether the electric strike is mounted to the left hand or right hand side of the door, and further depending on whether the door is hinged on the inside or the outside of a particular doorway. The edge of the strike frame 30 nearest the solenoid 74 is then positioned on the edge of the door frame-frame face opening 28. The electric strike 10 is next rotated through an arc to tightly position the mounting flanges 36 and mounting lip 42 in the recesses in the door frame 12. A bevel 37 defined by the end frame wall 31 provides clearance for the arced motion of the electric strike 10 during the installation. The bevel 37 allows the electric strike 10, having a total longitudinal length greater than the height of the frame opening 24, to be efficiently mounted to the door frame 12.

While a preferred embodiment of the present invention has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

What is claimed is:

1. An electric strike comprising:

a strike frame defining a jamb face opening and a frame face opening, said frame face opening generally orthogonal to said jamb face opening and contiguous with said jamb face opening;

keeper means mounted to said frame for defining a closed position to close said frame face opening, and movable to an open position to open said frame face opening, said keeper means defining a lock recess and said keeper means and said frame defining a bolt receiving cavity;

lock means for locking said keeper means in said closed position, said lock means comprising a swing arm and a lock pin mounted to said swing arm, said swing arm having an unlocked position and a locked position wherein said lock pin extends into said lock recess to lock said keeper means in said closed position;

bolt monitoring means for generating an output signal indicative of a bolt in said cavity, said monitoring means extending into said cavity.

2. The electric strike of claim 1 further comprising bias means for biasing said keeper means to one of said open position and said closed position.

3. The electric strike of claim 1 further comprising spring means for biasing said keeper means to said closed position.

4. The electric strike of claim 1 further comprising second bolt monitoring means extending into said cavity for generating an output signal indicative of a second bolt in said cavity, said second bolt monitoring means extending into said cavity.

5. The electric strike of claim 1 wherein said lock recess and said lock pin define conical shapes.

6. The electric strike of claim 1 wherein said lock means further comprises a swing arm spring biasing said swing arm to one of said locked and unlocked positions and a solenoid for driving said swing arm to the other of said locked and unlocked positions.

7. An electric strike comprising:

a strike frame defining a jamb face opening and a frame face opening, said frame face opening generally orthogonal to said jamb face opening and contiguous with said jamb face opening;

keeper means mounted to said frame for defining a closed position to close said frame face opening, and movable to an open position to open said frame face opening, said keeper means defining an open position recess and a closed position recess generally orthogonal to said open position recess, and said keeper means and said frame defining a bolt receiving cavity;

bias means for biasing said keeper means to one of said open position and said closed position, said bias means comprising a flat spring mounted to said frame and engageable in said open position and closed position recesses to maintain said keeper means in said open position and said closed positions, respectively;

lock means for locking said keeper means in said closed position;

bolt monitoring means for generating an output signal indicative of a bolt in said cavity, said monitoring means extending into said cavity.

8. The electric strike of claim 7 wherein said lock means comprises a swing arm having a locked position wherein said keeper means is locked in said closed position, and an unlocked position wherein said keeper means is movable to said open position.

9. The electric strike of claim 8 wherein said lock means further comprises a rotatable motor, and a spring coupling said motor and said swing arm, and rotation of said motor drives said swing arm between said locked and unlocked positions.

10. The electric strike of claim 9 wherein said spring is a coil spring and rotation of said motor expands and compresses said spring to drive said swing arm between said locked and unlocked positions.

11. The electric strike of claim 9 wherein said spring is a coil spring having coil faces and said motor rotates a pin slidably engaging said coil faces to drive said swing arm between said locked and unlocked positions.

12. The electric strike of claim 7 further comprising second bolt monitoring means extending into said cavity for generating an output signal indicative of a second bolt in said cavity, said second bolt monitoring means extending into said cavity.

13. An electric strike comprising:

a strike frame defining a jamb face opening and a frame face opening, said frame face opening generally orthogonal to said jamb face opening and contiguous with said jamb face opening;

keeper means mounted to said frame, said keeper means having a closed position for closing said frame face opening and an open position to open said frame face opening, said keeper means and said frame defining a bolt receiving cavity;

lock means having a locked position and an unlocked position, said lock means for locking said keeper means in said closed position in said locked position;

bolt monitoring means for generating an output signal indicative of a bolt in said cavity;

keeper monitoring means for generating an output signal indicative of said open position and said closed position of said keeper means, said keeper monitoring means comprising an electrical switch and a lever arm having a first end portion and a second end portion and pivot means between said first end portion and said second end portion for pivotally mounting said lever arm to said frame, said first end portion engaging said keeper means and said second end portion engaging said electrical switch; and lock monitoring means for generating an output signal indicative of said locked position and said unlocked position of said lock means.

14. The electric strike of claim 13 further comprising second bolt monitoring means for generating an output signal indicative of a second bolt in said cavity.

15. The electric strike of claim 13 wherein said bolt monitoring means comprises a lever arm having a first end portion and a second end portion and pivot means between said first and second end portions for pivotally mounting said lever arm to said frame, said first end portion extending into said bolt receiving cavity, and said second end portion actuating an electrical switch.

16. The electric strike of claim 13 further comprising biasing means for maintaining said keeper means in said closed position when said keeper means is in said closed position and maintaining said keeper means in said open position when said keeper means is in said open position.

17. The electric strike of claim 13 wherein said lock means comprises a swing arm having a locked position and an unlocked position, a rotatable motor, and a spring coupling said motor and said swing arm wherein rotation of said motor drives said swing arm between said locked and unlocked positions.

18. The electric strike of claim 17 wherein said spring is a coil spring, and rotation of said motor expands and compresses said spring to drive said swing arm between said unlocked and locked positions.

19. The electric strike of claim 17 wherein said spring is a coil spring having coil faces and said motor rotates a pin slidably engaging said coil faces to drive said swing arm between said locked and unlocked positions.

20. An electric strike comprising:

a strike frame defining a jamb face opening and a frame face opening, said frame face opening generally orthogonal to said jamb face opening and contiguous with said jamb face opening;

keeper means mounted to said frame, said keeper means having a closed position for closing said frame face opening and an open position to open said frame face opening, said keeper means and said frame defining a bolt receiving cavity;

lock means having a locked position and an unlocked position, said lock means for locking said keeper means in said closed position in said locked position;

bolt monitoring means for generating an output signal indicative of a bolt in said cavity;

keeper monitoring means for generating an output signal indicative of said open position and said closed position of said keeper means;

lock monitoring means for generating an output signal indicative of said locked position and said unlocked position of said lock means; and biasing means for maintaining said keeper means in said closed position when said keeper means is in said closed position and maintaining said keeper means in said open position when said keeper means is in said open position, said keeper means defining an open position recess and a closed position recess, and said biasing means comprises a flat spring engaging said open position recess when said keeper means is in said open position and said flat spring engaging said closed position recess when said keeper means is in said closed position.

21. The electric strike of claim 20 wherein said open position recess is generally orthogonal to said closed position recess.

22. An electric strike comprising:

a strike frame defining a jamb face opening and a frame face opening, said frame face opening generally orthogonal to said jamb face opening and contiguous with said jamb face opening;

keeper means mounted to said frame, said keeper means having a closed position for closing said frame face opening and an open position to open said frame face opening, said keeper means and said frame defining a bolt receiving cavity and said keeper means defines a lock pin recess;

lock means having a locked position and an unlocked position, said lock means for locking said keeper means in said closed position in said locked position and said lock means comprises a swing arm and a locking pin mounted to said swing arm, said swing arm having a first position wherein said pin engages said lock pin recess to lock said keeper means in said closed position and said lock swing arm having a second position wherein said keeper means is unlocked and swingable to said open position, said lock means further comprising drive means for driving said swing arm between said first and second positions;

bolt monitoring means for generating an output signal indicative of a bolt in said cavity;

keeper monitoring means for generating an output signal indicative of said open position and said closed position of said keeper means; and lock monitoring means for generating an output signal indicative of said locked position and said unlocked position of said lock means.

23. The electric strike of claim 22 wherein said lock monitor means comprises an electrical switch engaging said swing arm.

24. The electric strike of claim 22 wherein said strike frame defines a longitudinal axis and said drive means comprises a solenoid extending generally parallel to said axis and said frame defines a bevelled edge generally opposite said solenoid.

* * * * *